United States Patent [19]

Schwartz et al.

[11] Patent Number: 4,881,471

[45] Date of Patent: Nov. 21, 1989

[54] VERTICALLY ADJUSTABLE, RETROFITTABLE WORKSTATION

[75] Inventors: Edward M. Schwartz, Kansas City; Robert E. Morgan, Grain Valley; Wilburn D. Everman, Belton, all of Mo.

[73] Assignee: Edtech Company, Mo.

[21] Appl. No.: 268,415

[22] Filed: Nov. 8, 1988

[51] Int. Cl.[4] ..... A47B 9/12

[52] U.S. Cl. ..... 108/144; 248/244; 108/147

[58] Field of Search ..... 108/144, 147, 42, 44, 108/152, 108; 248/243, 244, 295.1

[56] References Cited

U.S. PATENT DOCUMENTS

| | | | |
|---|---|---|---|
| 1,307,610 | 6/1919 | Yeagley . | |
| 1,527,895 | 2/1925 | Mazoch | 108/147 |
| 2,937,692 | 5/1960 | McMichael . | |
| 3,982,801 | 9/1976 | Heidorn et al. | 108/147 X |
| 4,381,714 | 5/1983 | Henneberg et al. . | |
| 4,604,956 | 8/1986 | Grebel et al. | 108/147 |
| 4,619,208 | 10/1986 | Kurrasch | 108/147 |
| 4,627,364 | 12/1986 | Klein et al. | 108/147 |
| 4,667,605 | 5/1987 | Bastian | 108/144 |
| 4,747,353 | 5/1983 | Watt . | |

FOREIGN PATENT DOCUMENTS

| | | | |
|---|---|---|---|
| 1377922 | 9/1963 | France | 108/147 |
| 24864 | of 1897 | United Kingdom | 108/147 |

*Primary Examiner*—Peter A. Aschenbrenner

*Attorney, Agent, or Firm*—Sughrue, Mion, Zinn, Macpeak & Seas

[57] ABSTRACT

A vertically adjustable, retrofittable work station including a first pair of vertically oriented, spaced rails (5) having engaging teeth (10) protruding therefrom so as to be stationarily mounted on an existing wall panel (1) of a conventional work station, a second pair of vertically oriented rails (6) individually, slidably, interlockingly disposed in the first pair of rails (5), a pair of support brackets (3) having engaging teeth (17) protruding therefrom so as to be individually mounted on the second pair of rails (6), a work surfaces (4) supported by the support brackets (3), a pair of interconnecting channels (7, 8) for respectively interconnecting the first and second pairs of rails (5,6), and a drive mechanism coupled between the interconnecting channels to move the channels toward or away from each other so as to attendantly displace the work surface (4).

7 Claims, 3 Drawing Sheets

VERTICALLY ADJUSTABLE, RETROFITTABLE WORKSTATION

FIELD OF THE INVENTION

The invention relates to a device for retrofitting a work station such that the work surface can be automatically vertically adjusted to accommodate workers of different heights.

BACKGROUND OF THE INVENTION

There are at least 10 million video display terminals (hereinafter referred to as VDT's) in use across the country, and it is predicted that there will be at least 40 million VDT's by the end of this decade. While VDT's are used for a variety of tasks, they are used most intensively by a range of office workers who may spend the entire day key-punching and processing information. VDT's have been instrumental in increasing productivity and efficiency for virtually every major industry, and will continue to play a central role in this country's economy.

However, as the number of VDT's in the work place has risen, so have the health complaints associated with their use. Surveys indicate that a majority of full-time VDT users report high frequencies of health problems. Among other problems, recent studies confirm that VDT users have higher incidences of problems such as eye strain, headaches, insomnia, back and neck strain and fatigue.

As these health concerns have been recognized as legitimate and serious, steps are being taken in at least twenty states to introduce legislation to institute health and safety protections for VDT users. While questions have been raised regarding whether VDT's emit harmful radiation, studies show that the radiation levels emitted by the VDT's are well below levels naturally found in the environment. Thus, it is generally concluded that radiation is not the primary cause the physical problems discussed above. In contrast, numerous studies have indicated that operator injury such as carpal tunnel syndrome and tenosynovitis, which are cumulative trauma injuries, are caused by improper VDT workstation design.

In particular, the conventional VDT workstations is designed such that the work surfaces cannot be adjusted to accommodate people of different height. Shorter people must arch their body and elevate their arms in order to properly operate the keyboard and view the display terminal. In contrast, taller people have to hunch over to access the keyboard and view the terminal. Accordingly, the conventional VDT work stations have resulted in a high frequency of health-related problems.

FIG. 1 illustrates the conventional video display terminal work station. As shown in FIG. 1, the conventional work station includes a plurality of interconnected panels 1 having a plurality of elongate vertically extending support rails 2. Each of the support rails 2 includes a plurality of slots disposed along the vertical length thereof. Support brackets 3, having a plurality of teeth protruding therefrom, are secured to the support rails 2 by inserting the teeth of the support brackets into the complimentary corresponding slots of the support rails 2. The work surface 4 is supported by a pair of the supporting brackets 3.

Thus, while the conventional work surface is vertically adjustable, such vertical adjustment can only occur by disassembling the table top from the brackets and vertically adjusting the location of the support brackets on the support rails. Accordingly, to vertically adjust the conventional work surface it is necessary to remove all items therefrom, including the video display terminal. It is therefore not practical to adjust the height of the work surface on an hourly or daily basis to accommodate a change in shift of workers of different heights. Therefore, rapid, automatic, vertical adjustment of the work surface is not possible resulting in an unhealthy working environment.

SUMMARY OF THE INVENTION

It is an object of this invention to provide a retrofitting device for retrofitting an existing work station such that the work surface can be rapidly and automatically vertically adjustable.

It is a further object to provide a retrofitting device for retrofitting an existing work station such that the work surface can be vertically adjusted while the video display terminal is disposed thereon.

A further object is to provide an inexpensive retrofitting device for retrofitting a standard work station with a vertically adjustable work surface without requiring a redesign of the existing work station.

These and other objects which will become apparent from the ensuing description of the preferred embodiment of the invention are accomplished according to the present invention by a vertically adjustable, retrofittable work station adapted to be mounted to an existing wall panel. The retrofittable work station comprises a pair of horizontally spaced, vertically oriented support rails secured to the panel, a work surface, a first pair of elongate, vertically oriented, rails horizontally displaced from one another and adapted to be individually and stationarily mounted to the support rails, a second pair of elongate, vertically oriented, rails individually slidably mounted to the first pair of rails, means for individually mounting the support brackets and thus the work surface to the second pair of rails, a first elongate, horizontally oriented, channel member interconnecting the first pair of rails and a driving mechanism coupled between the first and second channel members for selectively displacing the channel members towards or away from each other to attendantly vertically displace the work surface. To allow for retrofit, the first pair of stationary rails have a plurality of teeth extending therefrom which are shaped and arranged in the same manner as the teeth which extend from the support bracket. In this manner, the stationary rails can be secured to the existing support rails. In addition, the second pair of slidably mounted rails have a plurality of slots corresponding to the slots in the existing support rails such that the existing support bracket can be secured to the slidable rails to thereby provide an automatically vertically adjustable work surface.

DESCRIPTION OF PREFERRED EMBODIMENTS

As discussed above and as shown in FIG. 1, the conventional work station includes a plurality of panels 1 interconnected by support rails 2 having slots disposed therein for receiving the correspondingly shaped teeth of the support bracket 3 for supporting the work surface 4. The retrofittable device of the invention is a vertically adjustable unit which is designed to be mounted on the existing support rails 2 and to support the existing support bracket 3 for supporting the work surface 4 in a vertically adjustable manner.

Figure 3:
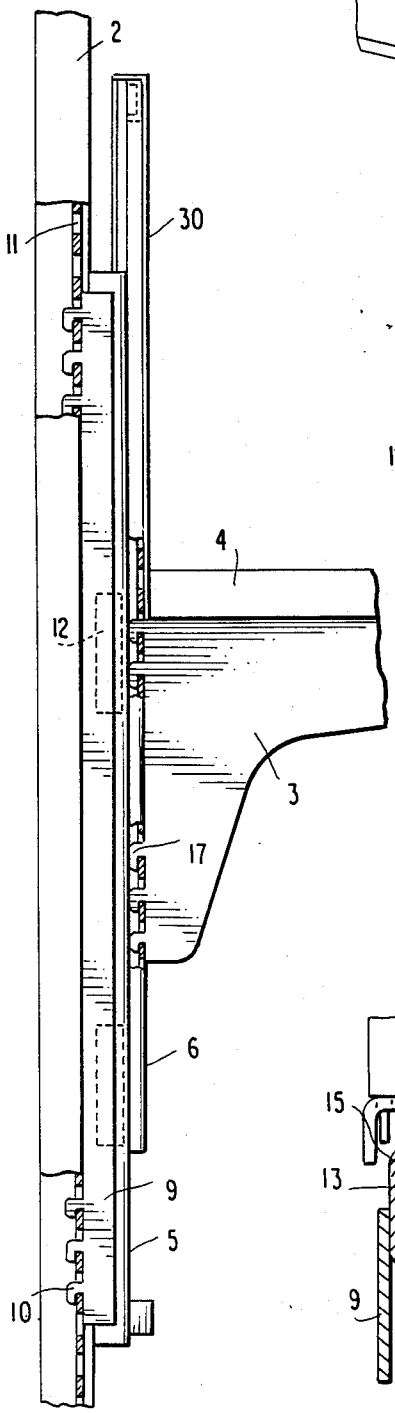
FIG. 3 is a side view of the vertically adjustable workstation of the invention.
Figure 2:
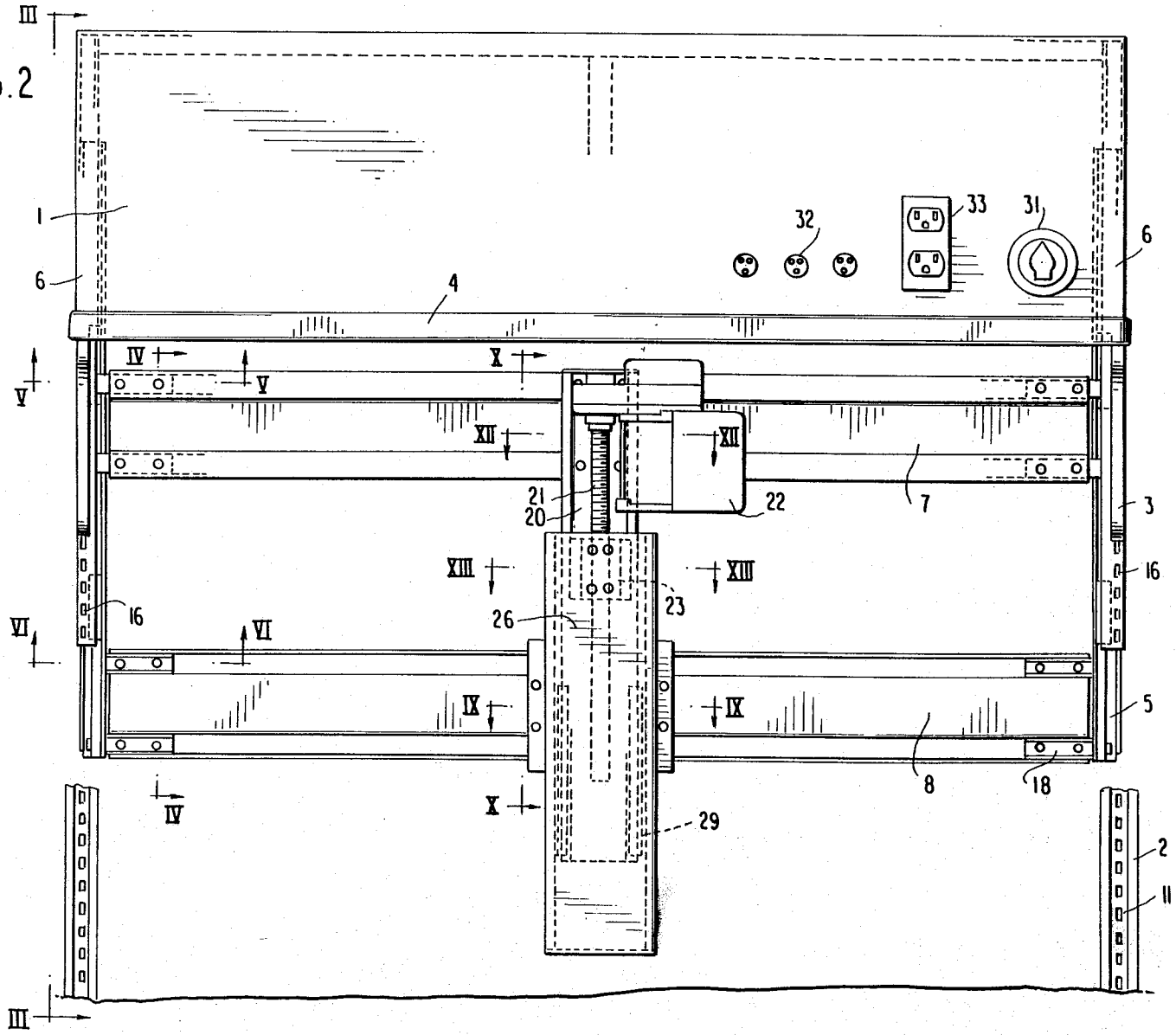
FIG. 2 is a front view of the vertically adjustable, retrofittable workstation of the present invention.

Particularly, as shown in FIGS. 2 and 3, the retrofittable device of the invention comprises a pair of stationary rails 5 adapted to be mounted on the existing support rails 2, a pair of slidable rails 6 individually slidably disposed on the stationary rails 5, a slidable channel 7 connecting each of the slidable rails 6, a fixed channel 8 connecting each of the stationary rails 5, a support bracket 3 for supporting the work surface 4 and a driving mechanism coupled to the slidable 7 and fixed channel 8 for selectively displacing the channels towards or away from each other to attendantly vertically displace the work surface 4.

Figure 5:
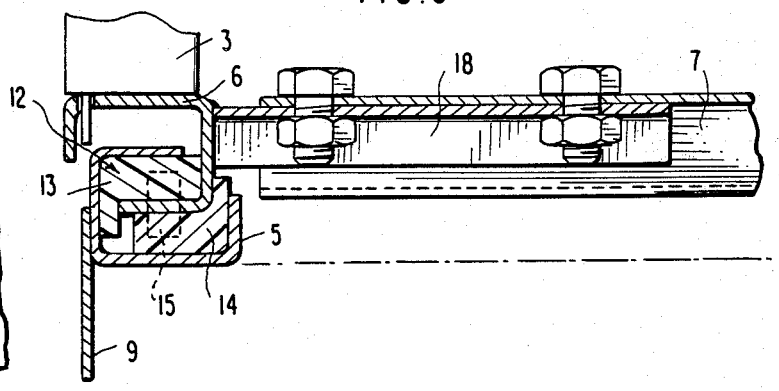
FIGS. 4, 5 and 6 are sectional views taken along the lines IV—IV, V—V and VI—VI of FIG. 2, respectively.
Figure 6:
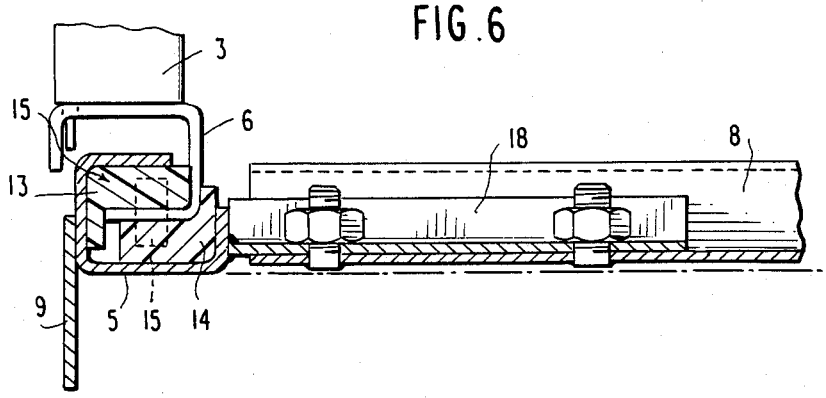

Referring to FIG. 3, the stationary rails 5 are vertically extending elongate members for securing the retrofittable device to the support rails 2 of the existing panel. In cross-section, the stationary rails 5 are substantially G-shaped as shown in FIGS. 5 and 6. Secured to each of the stationary rails 5 is an elongate securing plate 9 extending the length of the stationary rail 5. As shown in FIG. 3 the securing plate 9 has a plurality of engaging teeth 10 extending therefrom along the vertical length of the stationary rail 5. The teeth are shaped and arranged to correspond to the shape and arrangement of the teeth extending from the existing support bracket 3. Thus, the teeth 10 of the securing plates 9 are insertable into the slots 11 of the existing vertical support rails 2 in the same manner that the support brackets 3 are conventionally insertable into the slots 11 of the support rails so as to allow for the stationary rails 5, and hence the retrofittable device, to be easily mounted to the existing rails 2.

The slidable rails 6 are also G-shaped in cross-sections to correspond to the shape of the stationary rails 5 such that slidable rails 6 are individually slidably accommodated in the stationary rails 5 in the manner shown in FIGS. 3, 5 and 6. To allow for sliding movement between the slidable rails 6 and the stationary rails 5, a pair of sliding bushings 12 are secured to each of the slidable rails 6 at upper and lower portions thereof. Each of the bushings 12 comprise a pair of L-shaped substantially frictionless members 13,14 which are interconnected such that one of the frictionless members 13 is disposed on the inside of the G-shaped slidable rail 6 which the other frictionless member 14 is disposed on the outside of the G-shaped slidable rail 6. The frictionless members 13,14 are connected by dowel pins 15, screws or the like to the slidable rails 6. Thus, the frictionless members are fixedly attached to the slidable rails 6 so as to slide therewith relative to the stationary rails 5 to allow for smooth vertical adjustment of the slidable rails 6.

As shown in FIGS. 2 and 3, each of the slidable rails 6 has a plurality of slots 16 disposed along the length thereof. The slots 16 are shaped and arranged in the same manner as the slots 11 provided in the existing support rails 2. Accordingly, the existing support brackets 3 can be secured to the slidable rails 6 in the conventional manner by inserting the teeth 17 of the support brackets 3 into the complimentary slots 16 of the slidable rails 6.

The slidable channel 7 and fixed channel 8 respectively interconnect the slidable rails 6 and the stationary rails 5, as illustrated in FIG. 2. That is, the slidable rails 6 are interconnected by the slidable channel 7 and the stationary rails 5 are interconnected by the fixed channel 8. The channels 7,8 are dimensioned in length such that the overall width of the retrofittable device corresponds to the standard distance between existing support rails 2 in conventional work stations. For example, the distance between the support rails in standardized work stations is either 48 or 64 inches. Correspondingly, the channels are dimensioned such that the distance between the stationary rails is either 48 inches or 64 inches such that the retrofittable device can be used to retrofit any standard size work station.

Figure 4:
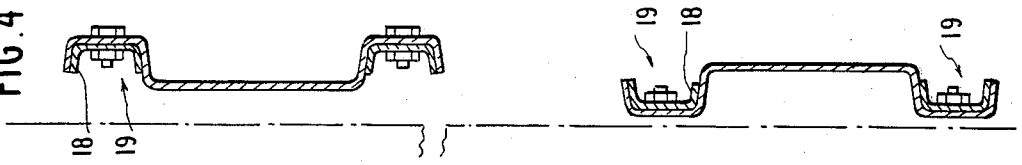

The cross-sectional shape of each of the channels 7,8 is in the form of a "W" resulting in a high bending strength with a minimal weight. The slidable channel 7 and stationary channel 8 are respectively connected to the slidable rails 6 and the stationary rails 5 in the manner shown in FIGS. 2, 5 and 6. Specifically, each of the stationary rails 5 and slidable rails 6 include a pair of U-shaped connector links 18 extending perpendicularly therefrom. Referring to FIG. 4, the slidable rail 6 and stationary rail 5 are respectively secured to the slidable channel 7 and fixed channel 8 by respectively securing the pair of connector links 18 to the outer correspondingly U-shaped portions 19 of the W-shaped channels using screws or the like.

Figure 1:
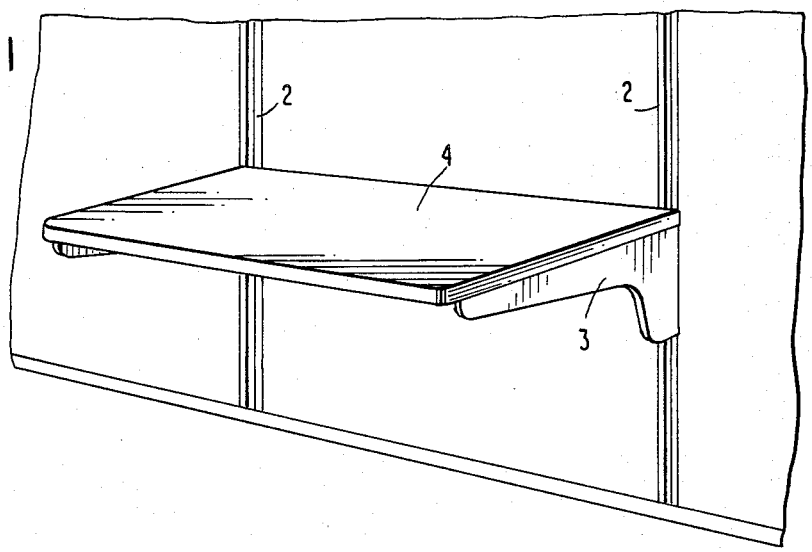
FIG. 1 is a perspective view of the conventional VDT workstation.

As shown in FIGS. 1 and 3, the support brackets 3 are substantially L-shaped members having a plurality of teeth 17 protruding therefrom. The teeth 17 are engageable with the slots 16 of the slidable rails 6 such that the support brackets 3 extend perpendicularly from the slidable rails 6 away from the existing panel 1 to support the work surface 4 thereon.

Having fully described the overall structure of the retrofittable device, the driving and guide mechanism for selectively displacing the channels toward or away from each other to attendantly displace the work surface will be described hereinafter.

Figure 8:
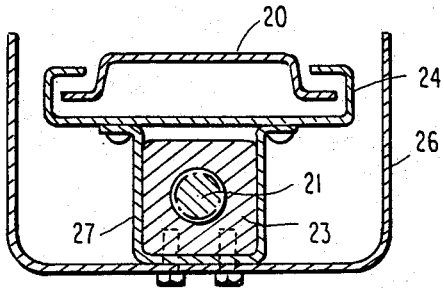
Figure 9:
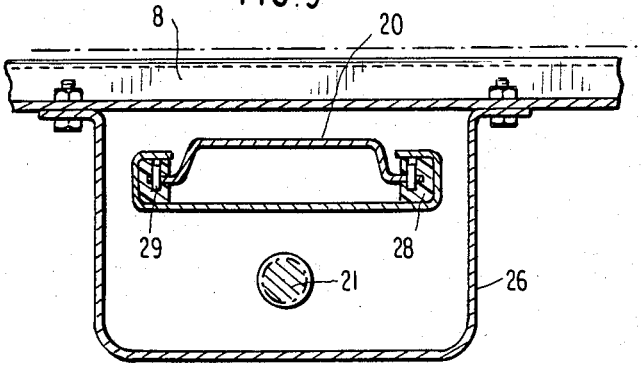

Referring to FIGS. 2 and 7-10, the driving/guide mechanism generally includes a slide plate 20, a drive screw 21 and a motor 22 secured to the slidable channel 7 as well as a drive nut 23 and a bearing bracket 24 fixedly attached to the fixed channel 8. The slide plate 20 is a substantially U-shaped plate which is fixedly secured to the slidable channel 7 at the top end of the slide plate 20 and which extends vertically downwardly therefrom. The slide plate 20 includes two flanges 25 on opposing side thereof to which linear bearings 28 are individually attached. In particular, the linear bearings 28 are substantially rectangular in cross-section and include a slot extending longitudinally thereto in which the flanges are respectively secured. The linear bearings 28 are individually secured to the flanges 25 using a plurality of dowel pin 29 inserted into aligned holes in the linear bearing and the flange, as shown in FIG. 9. Of course, the linear bearing could be secured to the flange by any suitable manner. The linear bearings 28 are in sliding engagement with the bearing bracket in the manner described hereinafter.

The motor 22 is fixedly secured to the slidable channel 7 and includes the rotatable drive screw 21 extending vertically downwardly therefrom. The drive screw 21 is threadedly engaged with the drive nut 23 which is fixedly secured to the stationary channel 8 in the following manner.

Figure 10:
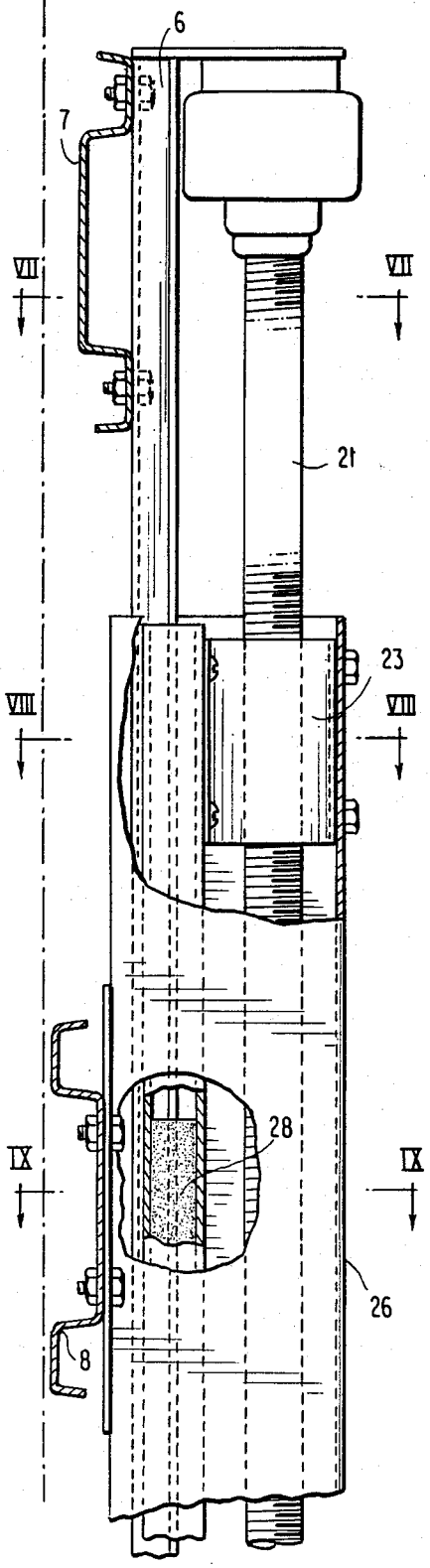
FIG. 10 is a sectional view taken along the line X—X of FIG. 2.
Figure 7:
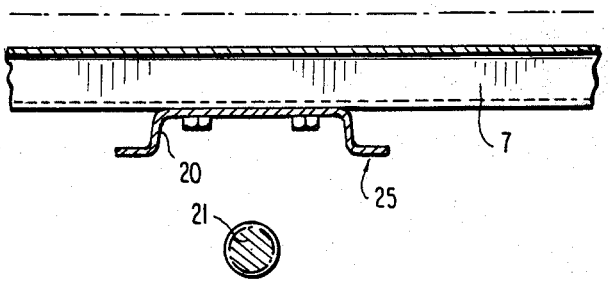
FIGS. 7, 8 and 9 are sectional views taken along the lines of VII—VII, VIII—VIII, and IX—IX of FIG. 2, respectively.

A substantially U-shaped vertically extending cover 26 is secured to the stationary channel as shown in FIGS. 2, 9 and 10. The cover 26 extends downwardly a sufficient distance to cover the drive mechanism. Secured to the interior portion f the cover is a U-shaped inner bracket 27 for securing the drive nut 23 and the bearing bracket 24. Specifically, the drive nut 23 is secured to the interior portion of the inner bracket 27 using screws or the like. The drive nut 23 is oriented such that the axis of the threaded hole extends in the vertical direction to receive the drive screw 21.

The bearing bracket 24 is secured to the inner bracket 27 as shown in FIG. 8. The bearing bracket 27 is substantially C-shaped and extends in the vertical direction. The outer portions of the bearing bracket are dimensioned to slidably receive the linear bearings 28 individually secured to the flanges 25 of the slide plate 20 in the manner described hereinabove. In this manner, the slide plate 20, in sliding contact with the bearing bracket 24, distributes the torsional force resulting from the torque of the drive screw to prevent any distortion of the device.

Accordingly, upon rotation of the drive screw, the slidable channel, and attendantly the slidable rails and the work surface, moves in the vertical direction to thereby adjust the elevation of the work surface.

A top cover 30 is provided above the work surface, as shown in FIG. 3. Specifically, the top cover 30 is connected at opposing lateral sides to the top of each slidable rail 6 and extends downwardly just below the work surface 4. Disposed on the top cover is the elevation adjustment switch 31 for selectively operating the motor to vertically displace the work surface to the desired elevation. Also disposed on the upper cover are the necessary VDT hook-up connections 32 as well as an electrical outlet 33. In addition, a lower skirt is disposed below the work surface to cover the portion of the drive mechanism which is not covered by the cover 26.

Having fully described the details of the invention, the retrofit procedure will be described hereinafter. Referring to FIG. 1, the desk top 11 and the existing support brackets 3 are removed from the existing vertical support rails 2. Thereafter, as illustrated in FIG. 3, the retrofittable device is attached to the existing rail 2 by securing the engagement teeth 10 of each of the stationary rails 5 into the slots of the existing support rails 2.

While the desk top can be automatically adjusted by a distance of twelve inches using the automatic drive mechanism, the retrofittable device can be secured at any elevation along the existing rails. For instance, the standard table top height is 30 ¼". Thus, it may be desirable to attach the retrofittable device to the existing rails such that the table top can be adjusted six inches in both the up and down direction with respect to the standard 30 ¼" table top height; thus, the table top can be automatically adjusted from 24 ¼" to 36 ¼".

Having secured the retrofittable device to the existing panel 1, the existing support brackets 3 are attached to the slidable rails 6 of the retrofittable device in the same manner that the support brackets 3 and normally attached to the existing rails 2. That is, the engagement teeth 17 of the existing support brackets 3 are inserted into the slots 16 of the slidable rails 6 so as to be securely attached thereto. It should be noted that the support brackets 3 can be attached at various elevations along the slidable rails 6 providing an additional adjusting feature. Once the support brackets are attached to the sliding brackets, the table top 4 is placed on top of the support brackets 3 in the usual manner.

Although the present invention describes the preferred embodiment of the invention, it should be understood that numerous modifications and adaptations may be resorted to without departing from the spirit of the invention. For instance, an emergency cut-off switch may be provided to prevent accidental vertical movement of the work surface.

Thus, the retrofittable work station according to the invention provides a solution to the problems associated with the conventional work stations discussed hereinabove. While the conventional work stations included substantially fixed, non-adjustable work surfaces resulting in stress related health problems for the VDT users, the invention provides a retrofittable work station having an automatically adjustable work surface to accommodate users of various heights to thereby provide a comfortable, substantially stress free working environment.

We claim:

1. A vertically adjustable, work station adapted to be mounted to a wall panel, comprising:

(a) a pair of horizontally spaced, vertically oriented support rails secured to said panel;

(b) a work surface;

(c) a pair of support brackets for supporting said work surface;

(d) a first pair of elongate, vertically oriented, rails horizontally displaced from one another and adapted to be individually and stationarily mounted to the support rails;

(e) a second pair of elongate, vertically oriented, rails individually slidably mounted to said first pair of rails;

(f) means for individually mounting said support brackets and thus said work surface to said second pair of rails;

(g) a first elongate, horizontally oriented, channel member interconnecting said first pair of rails;

(h) a second elongate, horizontally oriented, channel members interconnecting said second pair of rails; and (i) drive means coupled between said first and second channel members for selectively displacing said channel members towards or away from each other to attendantly vertically displace the work surface.

2. The work station of claim 1, wherein each of said support rails includes one of a plurality of slots and a plurality of teeth-like protrusions vertically disposed therealong and each of said first rails includes another of said plurality of slots and said plurality of teeth-like projections vertically disposed therealong wherein said protrusions are insertable into said slots to stationarily individually mount said first pair of rails to said support rails.

3. The work station of claim 1, wherein each of said second rails includes one of a plurality of slots and a plurality of teeth-like protrusions vertically disposed therealong and each of said support brackets includes another of said plurality of slots and said plurality of teeth-like projections vertically disposed therealong wherein said protrusions are insertable into said slots to stationarily individually mount said support brackets to said second rails.

4. The work station of claim 1, wherein said drive means comprises:

an elongate vertically extending drive screw rotatably secured to one of said first and second channel members;

a threaded nut fixedly secured to another of said first and second channel members, said drive screw being threadedly engaged with said nut; and mean for rotating said drive screw relative to said nut such that said drive screw and said nut move toward or away from one another to attendantly vertically displace the work surface.

5. The work station of claim 1, wherein each of said rails of said first and second pairs of rails are substantially C-shaped and wherein said second pair of rails are individually slidably interconnected to said first pair of rails with a substantially frictionless member interlocked therebetween.

6. The work station of claim 1, further comprising a slide support for providing support to said first and second channel members when said channel members are driven by said drive means.

7. The work station of claim 6, wherein said slide support comprises:

a vertically oriented slide plate fixedly connected to one of said first and second channel members and having flanges on opposing sides thereof;

a substantially frictionless member fixedly connected to each of said flanges;

a vertically oriented bearing bracket fixedly connected to another of said first and second channel members and having receiving portions on opposing sides thereof, said frictionless members being individually slidable disposed in said receiving portions of said bearing bracket so as to distribute the torsional forces associated with said drive means such that said first and second members can be smoothly, vertically displaced from one another.

* * * * *